US008774692B2

(12) United States Patent
Muramatsu et al.

(10) Patent No.: US 8,774,692 B2
(45) Date of Patent: Jul. 8, 2014

(54) FIXING DEVICE AND IMAGE FORMING APPARATUS INCORPORATING SAME

(75) Inventors: Satoshi Muramatsu, Kanagawa (JP); Kunihiko Tomita, Kanagawa (JP); Akiyasu Amita, Kanagawa (JP); Hiroyuki Kunii, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 183 days.

(21) Appl. No.: 13/537,912

(22) Filed: Jun. 29, 2012

(65) Prior Publication Data

US 2013/0004220 A1 Jan. 3, 2013

(30) Foreign Application Priority Data

Jun. 30, 2011 (JP) ..... 2011-146153

(51) Int. Cl.
*G03G 15/20* (2006.01)

(52) U.S. Cl.
USPC ..... 399/329; 399/67; 399/122; 399/341

(58) Field of Classification Search
USPC ..... 399/67, 122, 320, 341, 390, 400, 407
See application file for complete search history.

(56) References Cited

U.S. PATENT DOCUMENTS

| | | | |
|---|---|---|---|
| 6,370,352 | B1 | 4/2002 | Tomita |
| 6,778,788 | B2 | 8/2004 | Tomita et al. |
| 6,813,464 | B2 | 11/2004 | Amita et al. |
| 6,939,614 | B2 | 9/2005 | Tomita |
| 6,957,036 | B2 | 10/2005 | Kikuchi et al. |
| 7,010,257 | B2 | 3/2006 | Someya et al. |
| 7,031,648 | B2 | 4/2006 | Takashi et al. |
| 7,046,949 | B2 | 5/2006 | Tomita et al. |
| 7,054,570 | B2 | 5/2006 | Kishi et al. |
| 7,116,923 | B2 | 10/2006 | Kishi et al. |
| 7,127,202 | B2 | 10/2006 | Fujita et al. |
| 7,130,555 | B2 | 10/2006 | Kishi et al. |
| 7,139,520 | B2 | 11/2006 | Echigo et al. |
| 7,177,580 | B2 | 2/2007 | Nakafuji et al. |
| 7,209,675 | B2 | 4/2007 | Matsusaka et al. |
| 7,212,758 | B2 | 5/2007 | Kishi et al. |
| 7,212,759 | B2 | 5/2007 | Kishi et a |

(Continued)

FOREIGN PATENT DOCUMENTS

| | | | |
|---|---|---|---|
| JP | 04362679 | A * | 12/1992 |
| JP | 2004-085634 | A | 3/2004 |

(Continued)

*Primary Examiner* — David Gray
*Assistant Examiner* — Francis Gray
(74) *Attorney, Agent, or Firm* — Harness, Dickey & Pierce, P.L.C.

(57) ABSTRACT

A fixing device includes a fuser member, a stripper member, an endless rotary belt, a heater, a pressure member, and a belt cooler. The stripper member is disposed parallel to the fuser member. The endless rotary belt is looped for rotation around the fuser member and the stripper member in a longitudinal, conveyance direction of the belt. The heater is disposed adjacent to the belt to heat the belt. The pressure member is disposed opposite the fuser member via the belt. The fuser member and the pressure member press against each other via the belt to form a fixing nip therebetween. The recording medium after passage through the nip remains in contact with the belt as the belt moves from the fuser member toward the stripper member, and separates from the belt as the belt passes around the stripper member.

13 Claims, 6 Drawing Sheets

(56) References Cited

U.S. PATENT DOCUMENTS

| | | | |
|---|---|---|---|
| 7,233,762 | B2 | 6/2007 | Kunii et al. |
| 7,239,821 | B2 | 7/2007 | Matsusaka et al. |
| 7,254,360 | B2 | 8/2007 | Tomita |
| 7,254,362 | B2 | 8/2007 | Kikuchi et al. |
| 7,269,384 | B2 | 9/2007 | Someya et al. |
| 7,295,795 | B2 | 11/2007 | Suzuki et al. |
| 7,299,003 | B2 | 11/2007 | Kurotaka et al. |
| 7,308,216 | B2 | 12/2007 | Kishi et al. |
| 7,333,743 | B2 | 2/2008 | Kishi et al. |
| 7,333,760 | B2 | 2/2008 | Baba et al. |
| 7,343,113 | B2 | 3/2008 | Matsusaka et al. |
| 7,352,987 | B2 | 4/2008 | Iwata et al. |
| 7,356,270 | B2 | 4/2008 | Matsusaka et al. |
| 7,356,298 | B2 | 4/2008 | Tomita et al. |
| 7,359,666 | B2 | 4/2008 | Takashi et al. |
| 7,366,432 | B2 | 4/2008 | Kishi et al. |
| 7,369,803 | B2 | 5/2008 | Echigo et al. |
| 7,373,094 | B2 | 5/2008 | Kishi et al. |
| 7,433,641 | B2 | 10/2008 | Kikuchi et al. |
| 7,496,309 | B2 | 2/2009 | Matsusaka et al. |
| 7,515,845 | B2 | 4/2009 | Kishi et al. |
| 7,526,242 | B2 | 4/2009 | Takagaki et al. |
| 7,551,869 | B2 | 6/2009 | Kishi et al. |
| 7,565,087 | B2 | 7/2009 | Matsusaka et al. |
| 7,570,911 | B2 | 8/2009 | Nakafuji et al. |
| 7,583,922 | B2 | 9/2009 | Takashi et al. |
| 7,590,376 | B2 | 9/2009 | Tomita et al. |
| 7,603,049 | B2 | 10/2009 | Kishi et al. |
| 7,609,988 | B2 | 10/2009 | Kishi et al. |
| 7,664,410 | B2 | 2/2010 | Takagi |
| 7,738,827 | B2 | 6/2010 | Someya et al. |
| 7,885,569 | B2 | 2/2011 | Kishi et al. |
| 7,912,392 | B2 | 3/2011 | Yoshinaga et al. |
| 7,925,177 | B2 | 4/2011 | Ishii et al. |
| 7,957,663 | B2 | 6/2011 | Kishi et al. |
| 8,073,352 | B2 | 12/2011 | Kunii et al. |
| 8,131,198 | B2 | 3/2012 | Ishii et al. |
| 2002/0031363 | A1 | 3/2002 | Tomita et al. |
| 2003/0059224 | A1 | 3/2003 | Tomita et al. |
| 2003/0165348 | A1 | 9/2003 | Amita et al. |
| 2003/0207194 | A1 | 11/2003 | Tomita |
| 2004/0033431 | A1 | 2/2004 | Tomita |
| 2004/0037595 | A1 | 2/2004 | Takashi et al. |
| 2004/0245241 | A1 | 12/2004 | Kishi et al. |
| 2004/0247332 | A1 | 12/2004 | Kishi et al. |
| 2004/0247334 | A1 | 12/2004 | Kishi et al. |
| 2004/0258426 | A1 | 12/2004 | Kishi et al. |
| 2005/0025534 | A1 | 2/2005 | Fujita et al. |
| 2005/0025537 | A1 | 2/2005 | Echigo et al. |
| 2005/0117943 | A1 | 6/2005 | Nakafuji et al. |
| 2005/0139584 | A1 | 6/2005 | Kishi et al. |
| 2005/0152721 | A1 | 7/2005 | Kikuchi et al. |
| 2005/0158075 | A1 | 7/2005 | Echigo et al. |
| 2005/0175368 | A1 | 8/2005 | Matsusaka et al. |
| 2005/0175370 | A1 | 8/2005 | Matsusaka et al. |
| 2005/0191078 | A1 | 9/2005 | Kishi et al. |
| 2005/0201783 | A1 | 9/2005 | Kurotaka et al. |
| 2005/0207801 | A1 | 9/2005 | Kunii et al. |
| 2005/0232664 | A1 | 10/2005 | Tomita |
| 2005/0286920 | A1 | 12/2005 | Baba et al. |
| 2006/0008302 | A1 | 1/2006 | Someya et al. |
| 2006/0013624 | A1 | 1/2006 | Kurotaka et al. |
| 2006/0019082 | A1 | 1/2006 | Kikuchi et al. |
| 2006/0024095 | A1 | 2/2006 | Suzuki et al. |
| 2006/0029411 | A1 | 2/2006 | Ishii et al. |
| 2006/0039713 | A1 | 2/2006 | Kishi et al. |
| 2006/0051111 | A1 | 3/2006 | Kishi et al. |
| 2006/0051112 | A1 | 3/2006 | Matsusaka et al. |
| 2006/0051113 | A1 | 3/2006 | Kishi et al. |
| 2006/0051119 | A1 | 3/2006 | Kishi et al. |
| 2006/0051120 | A1 | 3/2006 | Kishi et al. |
| 2006/0051121 | A1 | 3/2006 | Matsusaka et al. |
| 2006/0088349 | A1 | 4/2006 | Someya et al. |
| 2006/0120776 | A1 | 6/2006 | Takashi et al. |
| 2006/0127118 | A1 | 6/2006 | Kishi et al. |
| 2006/0140689 | A1 | 6/2006 | Echigo et al. |
| 2006/0159477 | A1 | 7/2006 | Tomita et al. |
| 2006/0171749 | A1 | 8/2006 | Tomita et al. |
| 2006/0182460 | A1 | 8/2006 | Kishi et al. |
| 2007/0014600 | A1 | 1/2007 | Ishii et al. |
| 2007/0031159 | A1 | 2/2007 | Kishi et al. |
| 2007/0065188 | A1 | 3/2007 | Takagaki et al. |
| 2007/0104520 | A1 | 5/2007 | Nakafuji et al. |
| 2007/0212090 | A1 | 9/2007 | Matsusaka et al. |
| 2008/0145088 | A1 | 6/2008 | Matsusaka et al. |
| 2008/0219716 | A1 | 9/2008 | Takashi et al. |
| 2008/0253789 | A1 | 10/2008 | Yoshinaga et al. |
| 2009/0123172 | A1 | 5/2009 | Kishi et al. |
| 2009/0154967 | A1 | 6/2009 | Tomita |
| 2009/0169232 | A1 | 7/2009 | Kunii et al. |
| 2009/0317113 | A1 | 12/2009 | Kishi et al. |
| 2010/0232818 | A1 | 9/2010 | Kunii |
| 2010/0239337 | A1 | 9/2010 | Muramatsu et al. |
| 2010/0310289 | A1 | 12/2010 | Someya et al. |
| 2011/0064493 | A1 | 3/2011 | Muramatsu et al. |
| 2011/0064494 | A1 | 3/2011 | Amita et al. |
| 2011/0085815 | A1 | 4/2011 | Kishi et al. |
| 2011/0176822 | A1 | 7/2011 | Ishii et al. |
| 2011/0188911 | A1 | 8/2011 | Kunii et al. |
| 2012/0008153 | A1 | 1/2012 | Kunii et al. |

FOREIGN PATENT DOCUMENTS

| | | | | |
|---|---|---|---|---|
| JP | 2007199281 | A | * | 8/2007 |
| JP | 2010-145936 | A | | 7/2010 |
| JP | 2010145621 | A | * | 7/2010 |

* cited by examiner

FIXING DEVICE AND IMAGE FORMING APPARATUS INCORPORATING SAME

CROSS-REFERENCE TO RELATED APPLICATION

This patent application claims priority pursuant to 35 U.S.C. §119 to Japanese Patent Application No. 2011-146153, filed on Jun. 30, 2011, the entire disclosure of which is hereby incorporated by reference herein.

BACKGROUND OF THE INVENTION

1. Technical Field

The present invention relates to a fixing device and an image forming apparatus incorporating the same, and more particularly, to a fixing device that processes a toner image with heat and pressure on a recording medium, and an electrophotographic image forming apparatus, such as a photocopier, facsimile machine, printer, plotter, or multifunctional machine incorporating several of these features, which incorporates such a fixing device.

2. Background Art

In electrophotographic image forming apparatuses, such as photocopiers, facsimile machines, printers, plotters, or multifunctional machines incorporating several of those imaging functions, an image is formed by attracting toner particles to a photoconductive surface for subsequent transfer to a recording medium such as a sheet of paper. After transfer, the imaging process may be followed by a fixing process using a fixing device, which permanently fixes the toner image in place on the recording medium by melting and setting the toner with heat and pressure.

FIG. 1 is an end-on, axial view of a roller-based fixing device 310 employed in electrophotographic image formation.

As shown in FIG. 1, the fixing device 310 includes a pair of opposed rotary fixing members, one being a fuser roller 312 internally heated with a heat source 311 for fusing toner, and the other being a pressure roller 313 pressed against the heated roller 312, which together form a heated area of contact called a fixing nip N.

During operation, a rotary drive motor drives the fuser roller 312 to rotate in a given rotational direction (clockwise in the drawing), which in turn causes the pressure roller 313 to rotate in an opposite rotational direction (counterclockwise in the drawing). Heating of the fuser roller 312 is computer-controlled to maintain the roller surface at a temperature equal to or higher than the softening temperature of toner.

As the two rollers 312 and 313 rotate together, a recording sheet S bearing a toner image thereupon enters the fixing nip N, at which heat and pressure exerted from the opposed rollers 312 and 313 causes the toner to melt and fuse on the incoming sheet S. Then, as the recording sheet S exits the fixing nip N, the molten toner gradually cools and solidifies to fix in place on the recording sheet S.

FIG. 2 is an end-on, axial view of a belt-based fixing device 410 employed in electrophotographic image formation.

As shown in FIG. 2, the fixing device 410 includes a fuser belt 415 looped for rotation around a fuser roller 412 and a motor-driven heater roller 414 internally heated with a heat source 411, as well as a pressure roller 413 pressed against the fuser roller 412 via the fuser belt 415, which together form a fixing nip N therebetween.

During operation, a rotary drive motor drives the heater roller 414 to rotate in a given rotational direction (clockwise in the drawing), causing the belt 415 and the fuser roller 412 to rotate in the same rotational direction, which in turn causes the pressure roller 413 to rotate in an opposite rotational direction (counterclockwise in the drawing). Heating of the heater roller 414 is computer-controlled to maintain the belt 415 at a temperature equal to or higher than the softening temperature of toner.

As the fuser belt 415 and the rollers 411 through 413 rotate together, a recording sheet S bearing a toner image thereupon enters the fixing nip N, at which heat and pressure exerted from the opposed rollers 412 and 413 causes the toner to melt and fuse on the incoming sheet S. Then, as the recording sheet S exits the fixing nip N, the molten toner gradually cools and solidifies to fix in place on the recording sheet S.

Modern electrophotographic printers find application in high-quality printing processes with emergence of new imaging technologies. For example, the widespread use of digital cameras has led to an increased demand for printers that can reproduce digital image data on paper or other types of recording media as in the manner of analog, film-based photography. Also, with the development of print-on-demand (POD) technology which allows for small-lot, wide-variety printing services, there is a growing trend to replace a traditional offset printing press with an electophotographic printer, as the former involves costly production of printing plates and is typically less productive and less efficient than the latter.

A problem encountered when applying electrophotographic printing process to photographic image formation is insufficient gloss of an image printed and fixed on a recording medium. In general, a toner image processed through a roller-based or belt-based fixing device exhibits a gloss or reflectivity of about 60% at best. This level is significantly low when compared to that of a film-based photographic print which typically falls within a range from about 80% to 90%. The relatively low gloss of an electrophotographic print may be attributed primarily to minute damage to the printed surface caused where the recording medium, sticking to the fuser member due to adhesion of molten toner immediately after fixing, is forcibly detached from the fuser member.

Various techniques have been proposed to provide printing with high-gloss, photo-like imaging quality, several of which are directed to development of a more sophisticated fixing process.

For example, one known technique proposes a fixing device including an endless rotary fixing belt entrained around multiple rollers, including a heater roller and a stripper roller, parallel to each other, as well as a pressure roller pressed against the heater roller via the belt to form a fixing nip therebetween. Inside the loop of the fixing belt is a stationary, contact-cooling device, such as a heat sink, disposed in contact with the belt between the heater roller and the stripper roller to cool the belt downstream from the fixing nip.

Another known technique proposes a fixing device including an endless rotary fixing belt entrained around multiple rollers, including an upstream, inlet roller and a downstream, outlet roller, parallel to each other, with a pressure member pressed against the inlet roller via the belt to form a fixing nip therebetween. The downstream roller inside the loop of the fixing belt is configured as a hollow cooling roller accommodating a heat transfer fluid in its hollow interior, which absorbs heat from the belt and from the toner image downstream from the fixing nip.

According to this method, the fixing device is provided with an image gloss adjustment capability; a positioning mechanism for adjustably positioning the downstream roller to adjust a position at which a recording medium separates from the fixing belt, which in turn allows for adjusting an amount of heat removed from the toner image with the cooling roller. The fixing device thus adjusts an amount of gloss imparted to the resulting print by controlling the cooling efficiency of the cooling roller through the roller positioning mechanism.

Although generally successful for their intended purposes, the approaches depicted above have several drawbacks.

For example, employing a stationary, contact-cooling device for cooling the rotary belt results in sliding, frictional contact between the belt and the belt cooler, which move relative to each other where the former rotates while the latter does not during operation. Continuous friction between the belt and the belt cooler causes abrasion of their sliding surfaces, leading to possible damage to the belt as well as generation of dust particles from the worn surface of the belt cooler, which eventually migrate and cover the adjoining surfaces of the fuser roller and the stripper roller.

Presence of such particulate matter between the fixing roller and the belt can translate into a reduced area of contact, and therefore a reduced friction or traction between the roller and belt surfaces, which hinders proper rotation of the belt and causes various media conveyance failures, such as paper jams and multi-feeding. Further abrasion to the belt cooler can reduce an area of thermal contact between the belt and the belt cooler, leading to a reduced cooling efficiency which adversely affects glossing performance of the fixing device.

Also, employing a rotatable cooling roller, instead of a stationary cooling device, results in a reduced cooling efficiency due to a relatively small area of contact between the belt and the belt cooler, particularly where the cooling roller is positioned with a relatively low contact pressure against the belt. Increasing the contact pressure between the cooling roller and the belt to obtain a larger cooling efficiency is not practical, since it would in turn cause various concomitant failures, such as imaging defects, paper jams, and paper curls, in the fixing device.

SUMMARY OF THE INVENTION

Exemplary aspects of the present invention are put forward in view of the above-described circumstances, and provide a novel fixing device for processing a toner image on a recording medium.

In one exemplary embodiment, the fixing device includes a fuser member, a stripper member, an endless rotary belt, a heater, a pressure member, and a belt cooler. The stripper member is disposed parallel to the fuser member. The endless rotary belt is looped for rotation around the fuser member and the stripper member in a longitudinal, conveyance direction of the belt. The heater is disposed adjacent to the belt to heat the belt. The pressure member is disposed opposite the fuser member via the belt. The fuser member and the pressure member press against each other via the belt to form a fixing nip therebetween through which the recording medium is conveyed under heat and pressure. The recording medium after passage through the nip remains in contact with the belt as the belt moves from the fuser member toward the stripper member, and separates from the belt as the belt passes around the stripper member. The belt cooler includes at least three cooling rollers inside the loop of the belt, each of which contacts the belt to rotate at a uniform speed with the belt, while maintained at a temperature lower than that of the belt to absorb heat from the belt to in turn cool the recording medium in contact with the belt. Each of the cooling rollers is tangential to an inner circumferential surface of the belt to retain the belt in a curved configuration with a constant radius of curvature. At least one of the cooling rollers has a different diameter than that of the other cooling rollers.

Other exemplary aspects of the present invention are put forward in view of the above-described circumstances, and provide an image forming apparatus incorporating a fixing device.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description when considered in connection with the accompanying drawings, wherein.

DETAILED DESCRIPTION OF THE INVENTION

Figure 1:
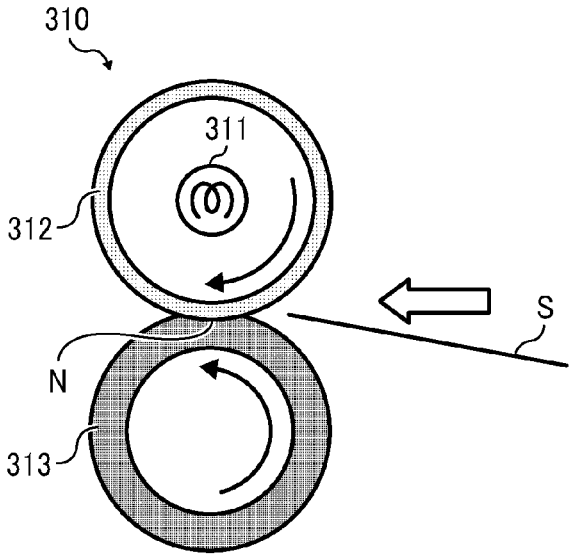
FIG. 1 BACKGROUND ART
FIG. 1 is an end-on, axial view of a roller-based fixing device employed in electrophotographic image formation.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

Figure 3:
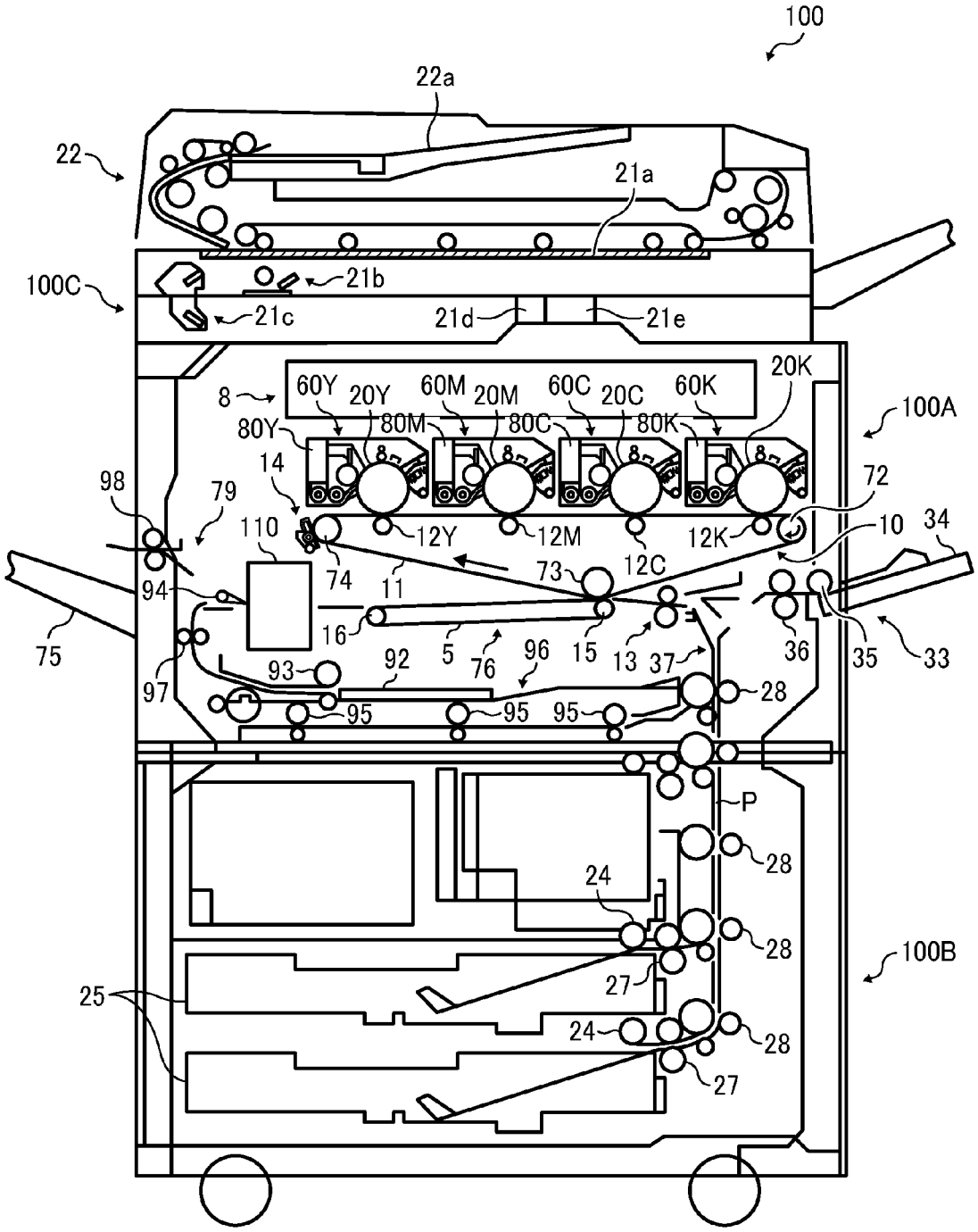
FIG. 3 schematically illustrates an image forming apparatus according to one embodiment of this patent specification.

FIG. 3 schematically illustrates an image forming apparatus 100 according to one embodiment of this patent specification.

As shown in FIG. 3, the image forming apparatus 100 is a digital color imaging system that can print a color image on a recording medium such as a sheet of paper S according to image data, consisting of an upper, printer section 100A, and a lower, sheet feeding section 100B, as well as an image scanner 100C deployed atop the printer section 100A, all of which are combined together to form a freestanding unit.

The printer section 100A comprises a tandem color printer that forms a color image by combining images of yellow, magenta, and cyan (i.e., the complements of three subtractive primary colors) as well as black, consisting of four electrophotographic imaging stations 60Y, 60M, 60C, and 60K arranged in series, each forming an image with toner particles of a particular primary color, as designated by the suffixes "Y" for yellow, "M" for magenta, "C" for cyan, and "K" for black, as well as an exposure device 8 disposed above the imaging stations 60, an intermediate transfer unit 10 including an intermediate transfer belt 11 extending along the imaging stations 60, and a secondary transfer unit 76 including a secondary transfer belt 5 adjacent to the intermediate transfer unit 10.

Each imaging station 60 includes a drum-shaped photoconductor 20 rotatable counterclockwise in the drawing, surrounded by various pieces of imaging equipment, such as a charging device 30, a development device 80 accommodating toner of the associated primary color, a cleaning device 70 for cleaning the photoconductive surface, and a discharging device 90 for removing electrostatic charge from the photoconductive surface (with the cleaner 70 and the discharger 90 not specifically labeled in FIG. 3), which work in cooperation to form a primary toner image on the photoconductive surface. An electrically biased, primary transfer roller 12 is disposed opposite the photoconductive drum 20 via the intermediate transfer belt 11 to form a primary transfer nip therebetween, at which the toner image is transferred from the photoconductive surface to the intermediate transfer belt 11 under electrical bias.

The exposure device 8 includes a light source, a motor-driven polygon minor, an f-θ lens, a reflection mirror, and various pieces of optical equipment, which work together to emit a modulated laser beam L for scanning the surface of the photoconductor drum 20.

In the intermediate transfer unit 10, the intermediate transfer belt 11 is entrained around multiple belt support rollers 72, 73 and 74 to rotate clockwise in the drawing, passing through the four primary transfer nips sequentially to carry thereon a multi-color toner image. A belt cleaner 14 is disposed facing the outer surface of the belt 11 where the belt 11 rotates around the support roller 74 before entering the primary transfer nips.

In the secondary transfer unit 76, the secondary transfer belt 5 is entrained around a pair of belt support rollers 15 and 16 to convey a recording sheet S thereon. The belt support roller 15 is electrically biased, and disposed opposite the belt support roller 73 of the intermediate transfer unit 10 via the belts 11 and 5 to form a secondary transfer nip therebetween, at which the toner image is transferred from the intermediate transfer belt 11 to the recording sheet S under pressure and electrical bias.

The fixing device 110 incorporates an endless rotary belt assembly to fix the toner image in place on the recording sheet S with heat and pressure. A detailed description of the fixing device 110 and its associated structure will be given later with reference to FIG. 5 and subsequent drawings.

The sheet conveyance section 100B includes one or more sheet trays 25 for accommodating a stack of recording sheets S; a pickup roller 24 and a separator roller 27 provided to each sheet tray 25 for feeding a recording sheet S from the sheet tray 25; and multiple conveyance rollers 28 and other guide mechanism, which together define a sheet conveyance path P for conveying the recording sheet S from the sheet tray 25 to between a pair of registration rollers 13, then through the secondary transfer nip, and then along the secondary transfer unit 5 into the fixing device 110.

Also included in the sheet conveyance section 100B are a duplex unit 96 disposed downstream from the fixing device 110 along the sheet conveyance path P, as well as a manual sheet feeder 33 and an output unit 79 disposed on opposite sides of the apparatus body.

The duplex unit 96 includes a temporary stacker 92 for accommodating a recording sheet S after processing through the fixing device 110; a reversing roller 93 for switchback or reversal of the direction of the sheet S; and multiple feed rollers 95 for forwarding the reversed sheet S toward the sheet conveyance path P upstream from the registration rollers 13.

The manual sheet feeder 33 includes a manual input tray 34, a feed roller 35, and a separator roller 36 for allowing manual feeding of a recording sheet S into the sheet conveyance path P.

The output unit 79 includes a pair of conveyance rollers 97 for introducing the recording sheet S into the duplex unit 97; a pair of output rollers 98 for ejecting the recording sheet S to outside the apparatus body; and a sheet diverter 94 for selectively directing the recording sheet S either toward the conveyance roller pair 97 or toward the output roller pair 98 upon exit from the fixing device 110.

The image scanner 100C includes a contact glass 21*a* for placing an original document thereon; a first scanning element 21*b* for directing light toward the original document placed; a second scanning element 21*c* for deflecting light reflected off the document surface; an imaging lens 21*d* for receiving light from the second scanning element 21*c*; and an optical sensor 21*e* for detecting light through the imaging lens 21*d* to capture image data of the original document. An automatic document feeder (ADF) 22 with a document input tray 22*a* may be provided in conjunction with the image scanner 100C to allow automatic feeding of an original document to the contact glass 21*a*.

To make a full-color copy from an original document with the image forming apparatus 100, a user initially places the original in the input tray 22*a* of the document feeder 22. Alternatively, the user may initially lift the document feeder 22 to place the original onto the contact glass 21*a*, and then restores the document feeder 22 into the original position.

With the original document thus set in position, the user presses a start button provided at a suitable user interface. Pressing the start button activates the scanner 100C immediately (or after the original document is automatically fed to the contact glass 21*a* in case the document feeder 22 is used), so that the first scanning element 21*b* illuminates the original with light from a light source, followed by the second scanning element 21*c* deflecting light reflected off the original through the imaging lens 21*c* toward the optical sensor 21*d*, which then analyzes the incoming light to obtain image data of the four primary colors for subsequent transmission to the printing section 100A.

In the exposure device 8, the light source generates a laser beam according to the image data obtained through scanning the original document. The laser beam is directed to the rotating surface of the motor-driven polygon mirror, then reflecting off the reflection mirrors, and eventually enters the f-θ lens, which directs the incoming light to impinge on the photoconductive surface.

Each imaging station 60 rotates the photoconductor drum 20 clockwise in the drawing to forward its outer, photoconductive surface to a series of electrophotographic processes, including charging, exposure, development, transfer, and cleaning, in one rotation of the photoconductor drum.

First, the photoconductive surface is uniformly charged by the charging device 30 and subsequently exposed to a modulated laser beam emitted from the exposure device 8. The laser exposure selectively dissipates the charge on the photoconductive surface to form an electrostatic latent image thereon according to image data representing a particular primary color. Then, the latent image enters the development device 80 which renders the incoming image visible using toner. The toner image thus obtained is forwarded to the primary transfer nip at which the incoming image is transferred to the intermediate transfer belt 11 from the photoconductor 20 under electrical bias generated by the primary transfer roller 12.

Figure 4:
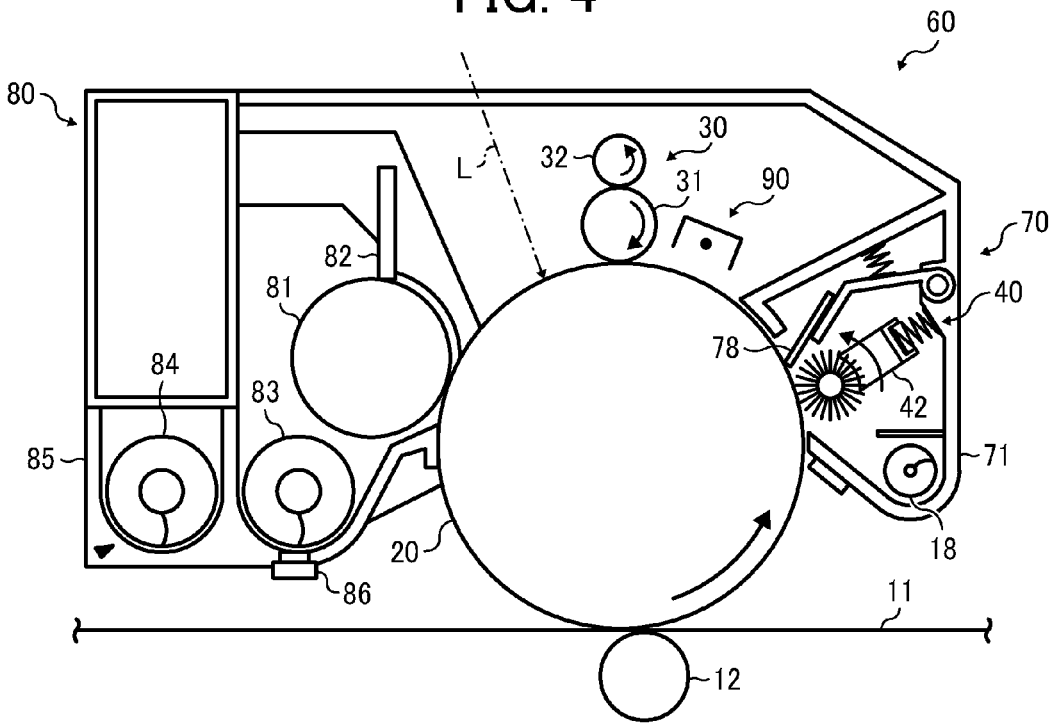
FIG. 4 is a detailed view of an imaging station included in the image forming apparatus of FIG. 3.

With additional reference to FIG. 4, the imaging station 60 is shown with its internal components depicted in greater detail.

As shown in FIG. 4, and as mentioned earlier, each imaging station 60 has the drum-shaped photoconductor 20 surrounded by the charging device 30, the development device 80, the cleaning device 70, and the discharging device 90, with the primary transfer roller 12 disposed opposite the photoconductive drum 20 via the intermediate transfer belt 11 to form a primary transfer nip therebetween. Since all the four imaging stations 60Y, 60M, 60C, and 60K are of a substantially identical configuration, the following provides a general description of the imaging mechanism which is applicable to each of the imaging stations 60Y, 60M, 60C, and 60K of the image forming apparatus 100.

In the imaging station 60, the photoconductor 20 may be any suitable photoconductive member upon which an electrostatical latent image is formed through scanning with a laser beam L emitted from the exposure device 8.

The charging device 30 includes a charging roller 31 facing the photoconductor 20 for imparting a uniform electric charge to the photoconductive surface. A voltage applicator is provided in connection with the charging roller 31 to apply an electrical potential generated by superimposing an alternating current bias on a direct current voltage. The charging roller 31 is held in contact with a cleaning roller 32 which removes residues from the charger surface as it rotates with the charging roller 31.

The development device 80 includes a housing 85 accommodating a two-component developer formed of a magnetic carrier and a toner of a particular color. In the developer housing 85 are a pair of first and second, parallel screw conveyors 83 and 84 which agitate and mix the developer with newly supplied toner to triboelectrically charge toner particles. A toner concentration sensor 86 may be provided to monitor the amount of toner in the developer within the housing 85. Upon detecting a low concentration of toner, the sensor 86 signals a toner supply controller to supply a suitable amount of toner from a bottle-shaped toner container connected to the developer housing 85.

Disposed adjacent to the first screw conveyor 83 is a development roller 81 consisting of a magnetic roller body and a cylindrical rotatable sleeve around the roller body onto which the developer is supplied from the adjoining screw conveyor 83 to form a layer of developer, with a doctor blade 82 held against the development roller 81 to regulate the thickness of the developer layer on the development roller 81.

The development roller 81 is equipped with a voltage applicator that applies an electrical bias to the roller body to cause the developer to form a bristle-like configuration over the roller sleeve, from which toner is electrostatically transferred from the development roller 81 to the photoconductor 20, so as to develop an electrostatic latent image on the photoconductive surface.

The cleaning device 70 includes a cleaning blade 78 held against the photoconductor 20 for scraping off residues, such as untransferred toner, carrier particles, paper dust, or other foreign matter from the photoconductive surface, with a dust collector or screw 18 disposed in a compartment 71 extending along the photoconductor 20 to collect the residual material from the photoconductive surface to one end of the compartment 71 for subsequent discharge from the cleaning device 70. A protector applicator 40 may be disposed in the cleaning device 70 to apply a protective agent 42 to the photoconductor 20, which protects the photoconductor 20 from deterioration due to electrical discharge with the discharging device closely located to the photoconductive surface, and from wear and tear due to contact with the cleaning blade 78.

The discharging device 90 includes any suitable discharging element that can remove electrostatic charge from the photoconductive surface to initialize the electrical potential on the photoconductor 20.

With continued reference to FIG. 3, as the multiple imaging stations 60 sequentially produce toner images of different colors at the four transfer nips along the belt travel path, the primary toner images are superimposed one atop another to form a single multicolor image on the moving surface of the intermediate transfer belt 11 for subsequent entry to the secondary transfer nip between the opposed rollers 73 and 15.

Meanwhile, the sheet conveyance section 100B selectively activates one of the pickup rollers 24 to pick up recording sheets S from atop the sheet stack in the sheet tray 25, followed by the separator roller 27 separating the sheets S one by one to introduce each separated sheet S between the pair of registration rollers 13 being rotated. Alternatively, in case of manual feeding, the sheet conveyance section 100B activates the feed roller 35 and the separator roller 36 to pick up a recording sheet S from the manual input tray 34, and introduces it into the sheet conveyance path P between the pair of registration rollers 13 being rotated.

Upon receiving the incoming sheet S, the registration rollers 13 stop rotation to hold the sheet S therebetween, and then advance it in sync with the movement of the intermediate transfer belt 11 to the secondary transfer nip.

At the secondary transfer nip, the multicolor image is transferred from the intermediate transfer belt 11 to the recording sheet S under pressure and electrical bias generated by the electrically biased roller. After secondary transfer, the belt 11 is cleared of residual toner for preparation to a future print job, whereas the recording sheet S is introduced into the fixing device 110 to fix the toner image in place under heat and pressure.

The recording sheet S, thus having its first side printed, is forwarded to the output unit 79 at which the sheet diverter 94 directs the incoming sheet S to the output roller pair 98 for output to the output tray 75 when simplex printing is intended, or alternatively, to the conveyance roller pair 97 when duplex printing is intended.

For duplex printing, the duplex unit 96 turns over the incoming sheet S for reentry to the sheet conveyance path P, wherein the reversed sheet S again undergoes electrophotographic imaging processes including registration through the registration roller pair 13, secondary transfer through the secondary transfer nip, and fixing through the fixing device 110 to form another print on its second side opposite the first side.

Upon completion of simplex or duplex printing, the recording sheet S is output to the output tray 75 for stacking outside the apparatus body, which completes one operational cycle of the image forming apparatus 100.

Figure 5:
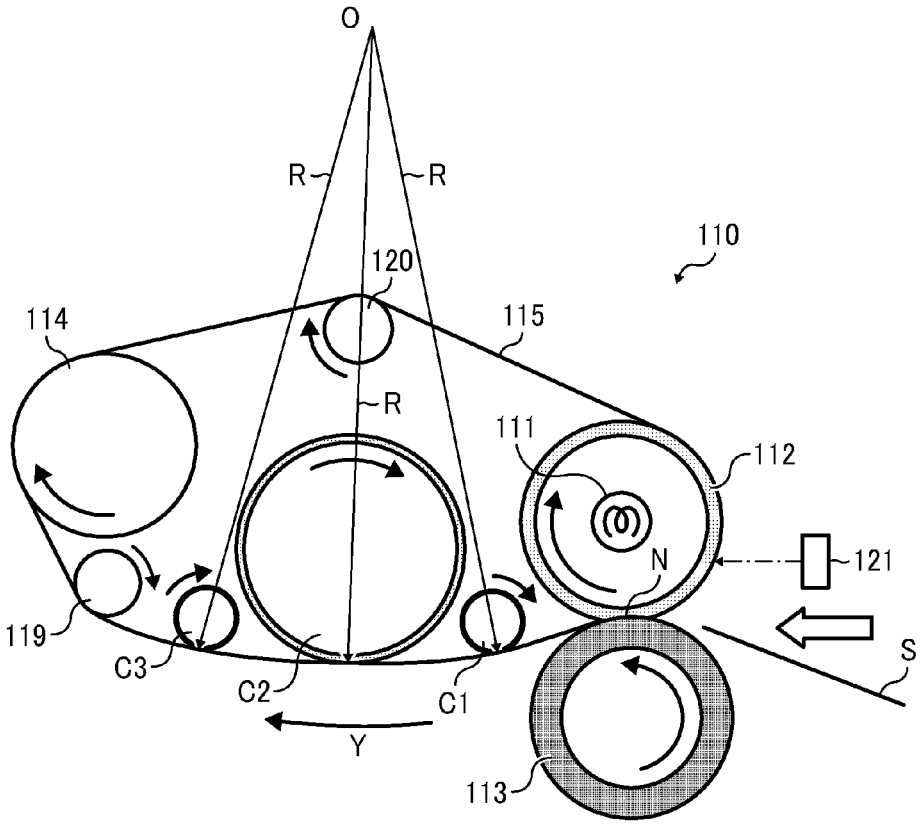
FIG. 5 is an end-on, axial view of the fixing device according to one or more embodiments of this patent specification.

FIG. 5 is an end-on, axial view of the fixing device 110 according to one or more embodiments of this patent specification.

As shown in FIG. 5, the fixing device 110 includes a fuser roller 112; a stripper roller 119 disposed parallel to the fuser roller 112; an endless rotary fixing belt 115 looped for rotation around the fuser roller 112 and the stripper roller 119 in a longitudinal, conveyance direction Y of the belt 115; a heater 111 adjacent to the belt 115 to heat the belt 115; a pressure roller 113 disposed opposite the fuser roller 112 via the belt 115; and a belt cooler including at least three, multiple cooling rollers C disposed inside the loop of the belt 115.

The fuser roller 112 and the pressure roller 113 press against each other via the fixing belt 115 to form a fixing nip N therebetween through which the recording sheet S is conveyed under heat and pressure. The recording sheet S after passage through the nip N remains in contact with the belt 115 as the belt 115 moves from the fuser roller 112 toward the stripper roller 119, and separates from the belt 115 as the belt 115 passes around the stripper roller 119. Each of the cooling rollers C contacts the fixing belt 115 to rotate at a uniform speed with the belt 115, while maintained at a temperature lower than that of the belt 115 to absorb heat from the belt 115 to in turn cool the recording sheet S in contact with the belt 115.

As used herein, the terms "upstream" and "downstream" refer to relative positions of components surrounding the fixing belt 115 in the longitudinal, conveyance direction Y in which the belt 115 moves from the fuser roller 112 toward the stripper roller 119 during operation of the fixing device 110. In particular, these terms are used to describe the position of the belt cooler with respect to the parallel rollers 112 and 119, in that the multiple cooling rollers C are arranged in series upstream from the fuser roller 112 and downstream from the stripper roller 119 in the conveyance direction Y of the belt 115.

Also included in the fixing device 110 are a motor-driven roller 114 disposed downstream from the stripper roller 119 for imparting a torque or rotational force to the fixing belt 115, and a tension roller 120 upstream from the fuser roller 112 for imparting tension to the fixing belt 115. A temperature sensor or thermistor 121 is disposed adjacent to the fuser roller 112 outside the loop of the fixing belt 115 and on the side of the fuser roller 112 away from the pressure roller 113 to measure temperature at an outer surface of the belt 115. A controller, such as a central processing unit (CPU) with associated memory devices, may be provided to control operation of the heater 111, for example, through on-off control according to readings of the thermistor 121 to maintain the belt temperature at a desired operational temperature.

Specifically, in the present embodiment, the fuser roller 112 comprises a hollow cylindrical body of metal, covered with an outer layer of heat-resistant, elastic material, such as silicone rubber deposited thereon.

The heater 111 comprises any suitable heating element that generates an amount of heat sufficient to melt and fuse toner accommodated in the fixing device 110. For example, the heater 111 may be a halogen heater accommodated in the hollow interior of the fuser roller 112 to radiate heat to an inner surface of the roller 112, from which heat is imparted to the fixing belt 115 entrained around the heated roller 112. Operation of the heater is computer-controlled according to readings of the thermistor 121 so as to maintain the belt surface at a desired operational temperature, such as, for example, in a range of from approximately 140° C. to approximately 160° C. within the fixing nip N.

The endless fixing belt 115 comprises a multi-layered flexible belt formed of a rigid substrate upon which is deposited an intermediate elastic layer for accommodating irregularities on the printed surface of a recording medium, as well as an outer layer of release agent for preventing adhesive material from sticking to the belt surface.

The substrate of the belt 115 may be formed of a sheet of metal, such as nickel, stainless steel, or the like, or alternatively, of heat-resistant resin, such as polyamide, polyimide, polyetheretherketone (PEEK), polyphenylene sulfide (PPS), or the like, which is resistant to bending and does not easily deform under tension.

The elastic layer of the belt 115 may be formed of a deposit of elastic material, such as silicone rubber, including silicone resin or silicone copolymer, and fluorine rubber, including fluorine resin or fluorine copolymer, or any combination of the same, which allows for good conformity of the belt with toner in the form of either powder or molten material, leading to high smoothness and high gloss of the resulting print.

The release layer of the belt 115 may be formed of a coating of fluorine resin, such as perfluoroalkoxy (PFA), polytetrafluoroethylene (PTFE), or the like, which allows for ready separation of a recording medium from the belt in the presence of fused, adhesive toner, while preventing the toner image from artifacts or reduced gloss due to undesired attachment to the belt surface.

The pressure roller 113 comprises a cylindrical body, either solid or hollow, of metal, covered with an outer layer of elastic material, such as silicone rubber deposited thereon. A pair of opposed ends of the roller cylindrical body is equipped with a suitable biasing mechanism, which allows for adjustably positioning the pressure roller 113 relative to the fuser roller 112 to adjust a width and strength of the fixing nip N defined therebetween.

During operation, upon entry into the fixing device 110, a recording sheet S bearing a toner image thereon passes through the fixing nip N with its printed surface facing the fuser roller 112 and another, opposite surface facing the pressure roller 113. Passage through the fixing nip N causes the toner image T to soften and melt under heat from the fuser roller 112 and pressure between the opposed rollers 112 and 113. The sheet S adheres to the fixing belt 115 due to adhesion of molten toner to the belt surface.

Downstream from the fixing nip N, the inner, back side of the fixing belt 115 is cooled by the cooling rollers C from inside the loop of the belt 115, which in turn cools the printed surface of the recording sheet S on the outer, front side of the belt 115. As the recording sheet S cools, the toner image T contacting the belt surface also cools and solidifies to assume a smooth, uniform surface in conformity with the smooth outer surface of the belt 115. Thereafter, the recording sheet S conveyed on the fixing belt 115 meets the stripper roller 119, at which the curvature of the stripper roller 119 causes the sheet S to separate from the belt surface and finally exit the fixing device 110.

With continued reference to FIG. 5, the belt cooler of the fixing device 110 is shown comprising an upstream cooling roller C1, an intermediate cooling roller C2, and a downstream cooling roller C3, arranged in series in the conveyance direction Y of the belt 115. Each of the cooling rollers C1 through C3 is tangential to an inner circumferential surface of the belt 115 to retain the belt 115 in a curved configuration with a constant radius R of curvature. At least one of the cooling rollers C1 through C3 has a different diameter than that of the other cooling rollers.

In the present embodiment, for example, of the three cooling rollers C1 through C3 provided between the fuser roller 112 and the stripper roller 119, the intermediate roller C2 is the largest in outer diameter, with the upstream and downstream rollers C1 and C3 being of a substantially similar size smaller than that of the intermediate roller C2.

Thus, the cooling rollers C1 through C3 are disposed along an imaginary, uniformly curved plane to which each of the cooling rollers C is tangent, so that the fixing belt 115 assumes a similar curved configuration where it contacts a recording sheet S being conveyed and cooled thereon downstream from the fixing nip N, that is, along the length between the fuser roller 112 and the stripper roller 119. The curvature radius R of the uniform curve is sufficiently large such that the recording sheet S does not separate from the belt 115 prematurely before it meets the stripper roller 119.

Providing the cooling rollers C1 through C3 to retain the belt 115 in the uniformly curved configuration allows for uniform contact pressure with which the cooling rollers C contact the belt 115, leading to high efficiency in cooling the belt 115 through thermal contact with the cooling rollers C, compared to a configuration where three or more cooling rollers are disposed along a flat, straight plane, which typically results in non-uniform contact pressure between the cooling rollers and the belt (that is, the contact pressure being higher between the belt and the upstream or downstream cooling roller than between the belt and the intermediate cooling roller), with a concomitant reduction in overall cooling efficiency of the belt cooler.

Hence, the fixing device 110 according to this patent specification can process a toner image with high gloss and high uniformity in gloss without compromising conveyance performance of the fixing belt or adding to the overall size and cost of the fixing device, wherein provision of the multiple cooling rollers C, each of which is tangential to an inner circumferential surface of the belt, and at least one of which has a different diameter than that of the other cooling rollers, enables efficient cooling of the fixing belt 115 to reliably cool the toner image downstream from the fixing nip N, which prevents damage to the smooth, printed surface caused where the recording medium, sticking to the fuser member due to adhesion of molten toner, is forcibly detached from the fixing belt.

Figure 6:
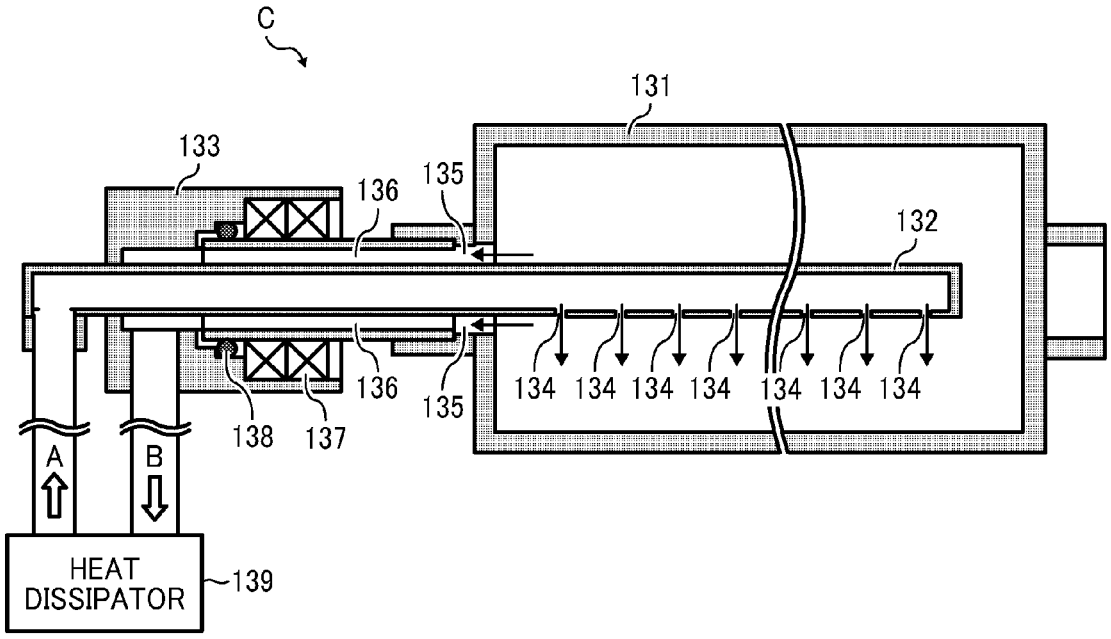
FIG. 6 is a cross-sectional view of a cooling roller included in the fixing device of FIG. 5.

FIG. 6 is a cross-sectional view of the cooling roller C included in the fixing device 110 of FIG. 5.

As shown in FIG. 6, the cooling roller C in the present embodiment comprises a liquid-based cooling mechanism including a hollow, thermally conductive roller body 131 to accommodate a liquid coolant such as water, and a rotary joint 133 connected to the roller body 131 to define an inlet and an outlet through which the liquid coolant flows into and out of the roller body 131. A heat dissipater 139 is connected to the rotary joint 133 to dissipate heat from the liquid coolant for recirculation into the roller body 131.

Specifically, the hollow, thermally conductive body 131 of the liquid-cooled cooling roller C is a rotatable cylinder of metal, having an opening 135 at one longitudinal end thereof to provide access to the hollow interior.

The rotary joint 133 has an internal supply tube 132 for supplying the liquid coolant therethrough, which is inserted into the roller body 131 through the end opening 135. A plurality of perforations 134 is defined in that portion of the tube 132 accommodated in the roller body 131, each of which serves as an inlet to establish fluid communication between the roller body 131 and the tube 132. Within the opening 135 is a space between the adjoining surfaces of the roller body 131 and the tube 132, which serves as an outlet to establish fluid communication between the roller body 131 and the tube 132. Also, the rotary joint 133 has a fluid outlet passage 136 defined around the internal tube 132, provided with a bearing 137 and a sealer or O-ring 138, which connects to the opening 135 to allow drainage of the liquid coolant into the heat dissipater 139.

The heat dissipater 139 includes any suitable cooling device, for example, a fan-cooled radiator provided with a suitable cooling fan to direct air flow toward the radiator. A suitable pump may be provided between the heat dissipater 139 and the rotary joint 133 to impart pressure or driving force to the liquid coolant throughout the liquid-based cooling system.

During operation, the liquid coolant flows into the internal supply tube 132 of the rotary joint 133 under pressure exerted by the pump. Passing through the tube 132, the liquid coolant enters the roller body 131 via the inlet openings 134. Upon entering the roller body 131, the liquid coolant absorbs heat from those portions of the roller wall heated through contact with the heated belt 115, thereby maintaining the roller temperature at a substantially constant, low temperature.

After circulating within the roller body 131, the liquid coolant passes through the outlet opening 135 to enter the outlet passage 136, leading to the heat dissipater 139 where the incoming coolant is cooled through the radiator cooled with the fan. The liquid coolant exiting the heat dissipater 139 is pumped to again flow into roller body 133 through the rotary joint 133.

In the present embodiment, the cooling roller 110 is maintained within a temperature ranging from approximately 30° C. to approximately 50° C., such that the temperature of the fixing belt 115 heated to approximately 140° C. to approximately 160° C. at the fixing nip N falls within a range from approximately 30° C. to approximately 50° C. as the belt 115 reaches the stripper roller 119 after passing through the cooling rollers C.

Adjustment of temperature of the cooling roller C may be performed by adjusting operational parameters of the cooling mechanism, such as, for example, the cooling capacity of the radiator dissipating heat, the flow rate of the liquid coolant forced by the pump, or the flow rate of the air flow directed to the radiator by the cooling fan.

Figure 7:
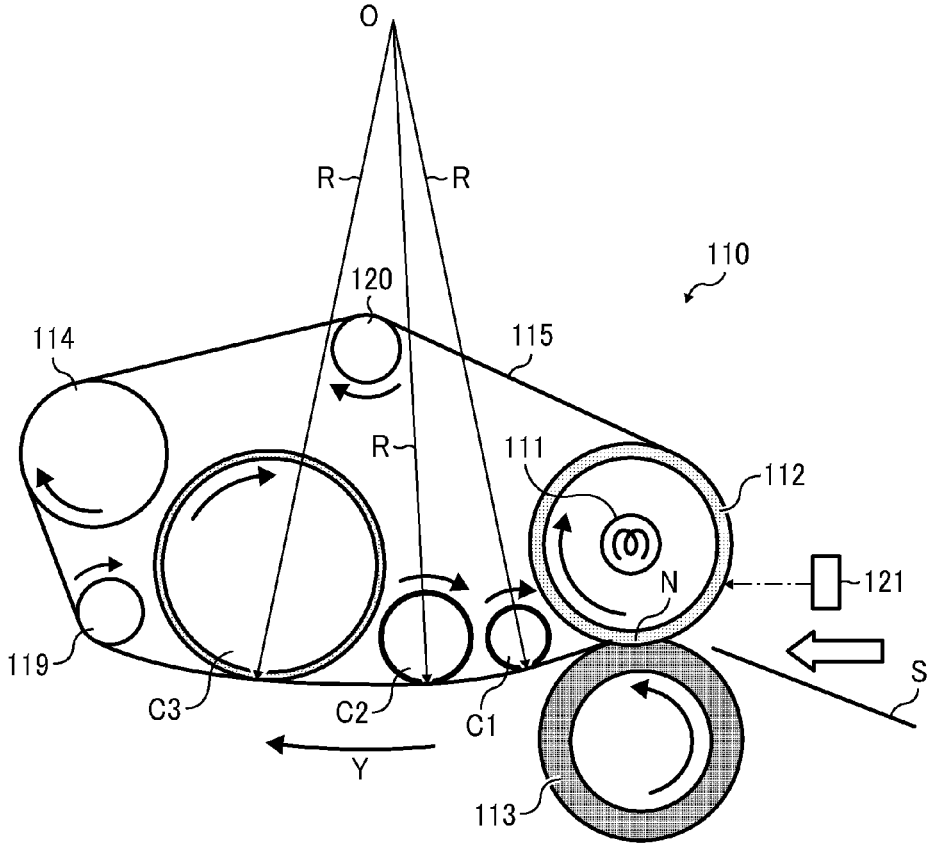
FIG. 7 is an end-on, axial view of the fixing device according to another embodiment of this patent specification.

FIG. 7 is an end-on, axial view of the fixing device 110 according to another embodiment of this patent specification.

As shown in FIG. 7, the overall configuration of the fixing device 110 is similar to that depicted primarily with reference to FIG. 5, including an upstream cooling roller C1, an intermediate cooling roller C2, and a downstream cooling roller C3, arranged in series in the conveyance direction Y of the belt 115 (each of which incorporates a liquid-based cooling mechanism depicted in FIG. 6), except for the relative sizes of the multiple cooling rollers.

Specifically, in the present embodiment, of the three cooling rollers C1 through C3 provided between the fuser roller 112 and the stripper roller 119, the upstream roller C1 is the smallest in outer diameter and the downstream roller C3 is the largest in outer diameter, with the intermediate roller C2 being of a size between those of the upstream and downstream rollers C1 and C3.

In such a configuration, where the fixing device 110 is operated in a room temperature of approximately 25° C. with the fuser roller 112 heated to approximately 150° C., the surface of the fixing belt 115 retains a substantial amount of heat upon exiting the fixing nip N. As the belt 115 passes through the cooling rollers C1 through C3 sequentially, the belt temperature, which is about 100° C. immediately upstream from the upstream cooling roller C1, gradually decreases to about 70° C. to 80° C. immediately upstream from the intermediate cooling roller C2, and to 50° C. to 60° C. immediately upstream from the downstream cooling roller C3.

Where the temperature of each cooling roller C is maintained within a temperature range comparable to the room temperature, such gradual decrease in the belt temperature downstream from the fixing nip N translates into different temperature gradients of the cooling rollers C relative to the belt 115, resulting in different heat transfer rates to the belt 115 from the cooling rollers C. That is, the upstream cooling roller C1 exhibits a relatively high heat transfer rate due to a relatively high temperature gradient between the belt 115 and the roller C1, whereas the downstream cooling roller C3 exhibits a relatively low heat transfer rate due to a relatively low temperature gradient between the belt 115 and the roller C3.

Dimensioning the roller size depending on the distance from the fuser roller 112 compensates for such variations in the heat transfer rate. That is, the smallest cooling roller C1 effectively absorbs heat from the belt 115 owing to its relatively high heat transfer rate from the belt 115, whereas the largest cooling roller C3, despite its relatively low heat transfer rate from the belt 115, also effectively absorbs heat from the belt 115 owing to a relatively large area of contact between the roller C3 and the belt 115. Such arrangement enables the belt cooler to reliably cool the fixing belt 115 to a desired temperature of approximately 40° to approximately 50° C. where the belt 115 meets the stripper roller 119, which allows the toner to completely solidify while retaining a smooth configuration and high gloss upon separation from the belt 115.

Thus, providing the cooling rollers C with the outer diameters increasing with increasing distance from the fuser roller 112 results in effective heat transfer from the fixing belt 115 to the respective cooling rollers C, which allows for increasing cooling efficiency of the belt cooler without adding to the overall size of the fixing device 110.

Figure 8:
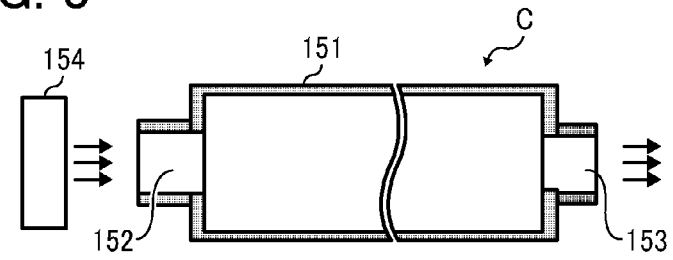
FIG. 8 is a cross-sectional view of a cooling roller included in the fixing device according to still another embodiment of this patent specification.

FIG. 8 is a cross-sectional view of the cooling roller C included in the fixing device 110 according to still another embodiment of this patent specification.

As shown in FIG. 8, the cooling roller C in the present embodiment comprises an air-based cooling mechanism, as opposed to a liquid-based cooling mechanism, including a hollow, thermally conductive open-ended roller body 151, and a cooling fan 154 connected to the roller body 151 to generate an air flow from one end to the other of the roller body 151.

Specifically, the hollow, thermally conductive body 151 of the air-cooled cooling roller C is a rotatable cylinder of metal, a pair of inlet and outlet openings 152 and 153 at two opposite longitudinal ends thereof to provide access to the hollow interior. The cooling fan 154 is connected to the inlet opening 152 to generate an air flow from one longitudinal end to the other of the roller body 151.

During operation, the cooling fan 154 causes air to flow into the roller body 151 via the inlet opening 152. Upon entering the roller body 151, the cooling air absorbs heat from those portions of the roller wall heated through contact with the heated belt 115, thereby maintaining the roller temperature at a substantially constant, low temperature. Thereafter, the cooling air, now heated, exits the roller body 151 via the outlet opening 153.

Compared to a liquid-based cooling device which often requires costly or complicated equipment for liquid handling, the air-based cooling mechanism depicted above is relatively simple in structure. For effective cooling with the air-cooled cooling roller C, a pair of intake and exhaust ducts may be provided to the longitudinal ends of the roller body 151, which, in combination with an appropriate positioning of the cooling mechanism, provides a smooth continuous flow of fresh cold air from the outside and heated warm air to the outside.

For comparison purposes, and for allowing an understanding of the belt cooler according to this patent specification, the following describes several comparative examples with different configurations of a fixing device employing a roller-based belt cooling mechanism, with reference to FIGS. 9 through 12.

Figure 9:
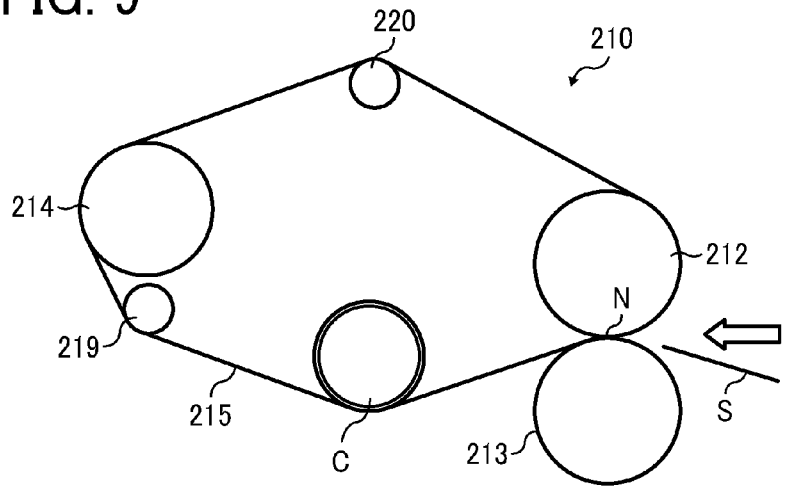
FIG. 9 is an end-on, axial view of a fixing device employing a roller-based belt cooler.

FIG. 9 is an end-on, axial view of a fixing device 210 employing a roller-based belt cooler.

As shown in FIG. 9, the overall configuration of the fixing device 210 is similar to that depicted with reference to FIG. 5, including a fixing belt 215 entrained around a fuser roller 212 and a stripper roller 219, as well as a motor-driven roller 214 and a tension roller 220, with a pressure roller 213 pressing against the fuser roller 212 via the belt 215 to form a fixing nip N therebetween, except that the fixing device 210 includes a single cooling roller C, instead of multiple cooling rollers, disposed inside the loop of the belt 215 for cooling the belt 215.

Note that in this fixing device 210, unlike the fixing device 110 of FIG. 5, the single cooling roller C positioned between the fuser roller 212 and the stripper roller 219 causes the fixing belt 215 to bend or bow significantly outward. Such deformation of the belt 215 can induce partial or entire loss or flaking of toner from the recording sheet S, which not only detracts from gloss or uniformity in gloss of the resulting print, but also makes it difficult to properly convey the recording sheet S where the loss of toner makes the recording medium S susceptible to separate or fall off from the belt surface, resulting in malfunction or paper jam in the fixing device. Should the recording sheet S be processed without a conveyance failure, the resulting print may suffer curling or deformation, where the recording sheet S conforms to the bent configuration of the belt 215 during cooling, and retains its deformed, bent shape after exit from the fixing device 210.

Figure 10:
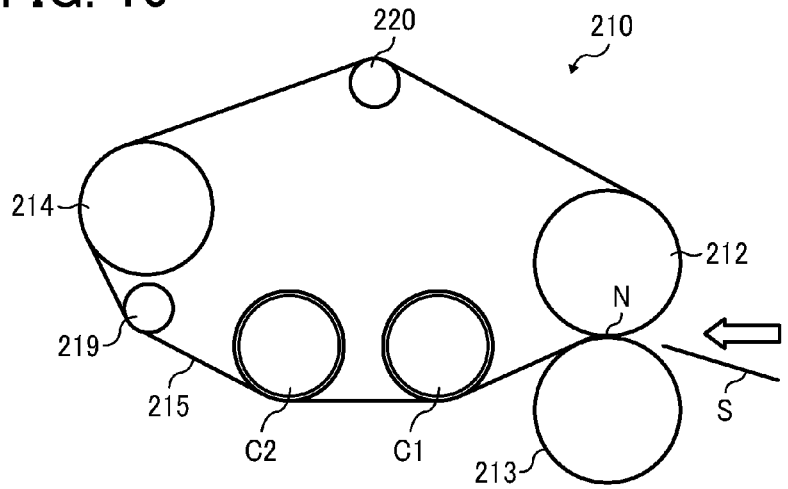
FIG. 10 is an end-on, axial view of a fixing device employing another roller-based belt cooler.

A similar problem can occur even where the fixing device 210 employs a pair of cooling rollers C1 and C2, in place of a single cooling roller C, insofar as the dual cooling rollers cause significant bending or bowing of the fixing belt 215 between the fuser roller 212 and the stripper roller 219, as shown in FIG. 10.

Figure 11:
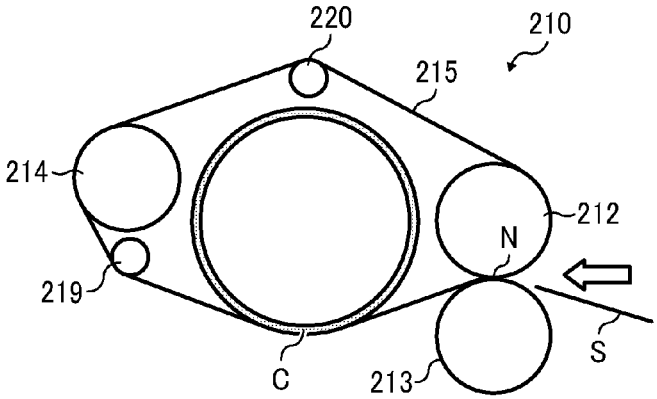
FIG. 11 is an end-on, axial view of a fixing device employing still another roller-based belt cooler.

FIG. 11 is an end-on, axial view of another fixing device 210 employing a roller-based belt cooler.

As shown in FIG. 11, the fixing device 210 may employ a single cooling roller C larger in diameter than the foregoing examples to obtain a larger contact angle and thus a larger area of contact between the fixing belt 215 and the cooling roller C.

Increasing the size of the cooling roller C effectively alleviates the problem associated with cooling the belt with a single cooling roller as long as the fixing process is performed on a relatively thin, flexible recording medium. However, this is not the case with rigid recording media, such as thick paper and coated paper, which are often accommodated in a belt-based fixing process owing to their high compatibility with high-gloss printing. A recording medium of this type tends to retain an original, straight configuration and therefore is ready to separate from the belt surface as the belt bends or bows significantly outward along the cooling roller, resulting in malfunction or paper jam in the fixing device.

Addressing the problem by further increasing the size of roller is not desirable, since it necessitates a concomitant increase in the overall size and cost of the fixing device. Alternatively, instead, it may be more practical to increase the number of cooling rollers while reducing the size of each cooling roller, as shown in FIG. 12.

Figure 12:
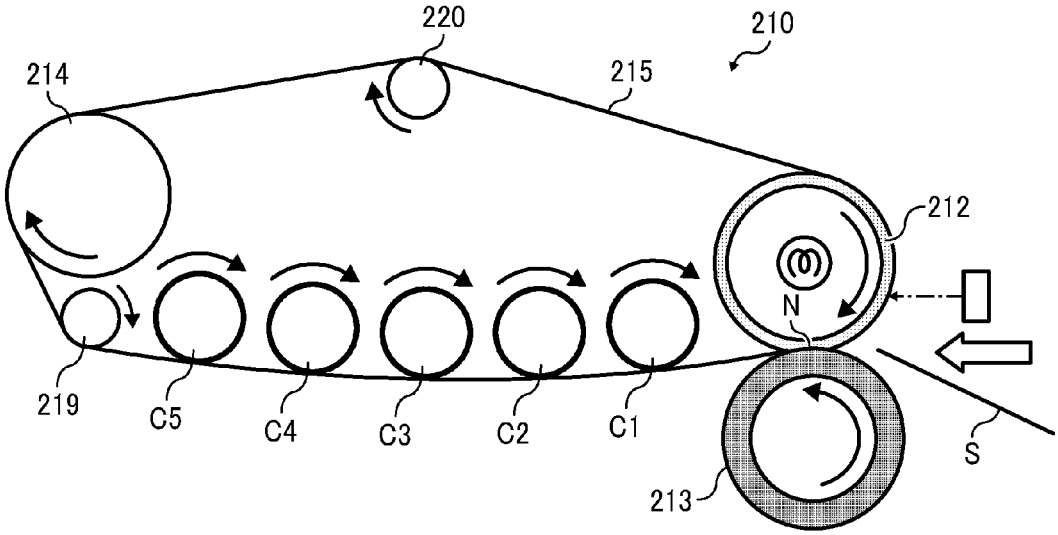
FIG. 12 is an end-on, axial view of a fixing device employing yet still another roller-based belt cooler.

As shown in FIG. 12, the fixing device 210 may employ multiple cooling rollers C1 through C5 of a uniform size smaller in diameter than the foregoing examples to obtain stabilized conveyance and consistently high glossing performance of the fixing device.

A drawback of this example is a relatively small area of contact between each cooling roller and the fixing belt 215, which can hinder cooling efficiency of the belt cooler. Addressing the problem by further increasing the number of rollers is not desirable, however, since it necessitates a concomitant increase in the overall size and cost of the fixing device.

Hence, as all these comparative examples exemplify, using a belt cooler based on a single cooling roller or multiple equally-sized cooling rollers would not allow a belt-based fixing device to print a toner image with good imaging quality without compromising conveyance performance of the fixing belt or adding to the overall size and cost of the fixing device.

By contrast, the fixing device 110 according to this patent specification can process a toner image with high gloss and high uniformity in gloss without compromising conveyance performance of the belt or adding to the overall size and cost of the fixing device, wherein provision of the multiple cooling rollers C, each of which is tangential to an inner circumferential surface of the belt, and at least one of which has a different diameter than that of the other cooling rollers, enables efficient cooling of the fixing belt 115 to reliably cool the toner image downstream from the fixing nip N, which prevents damage to the smooth, printed surface caused where the recording medium, sticking to the fuser member due to adhesion of molten toner, is forcibly detached from the fixing belt. The image forming apparatus 100 incorporating the fixing device 110 according to one or more embodiments of this patent specification benefits from those and other effects of the fixing device 110.

Figure 2:
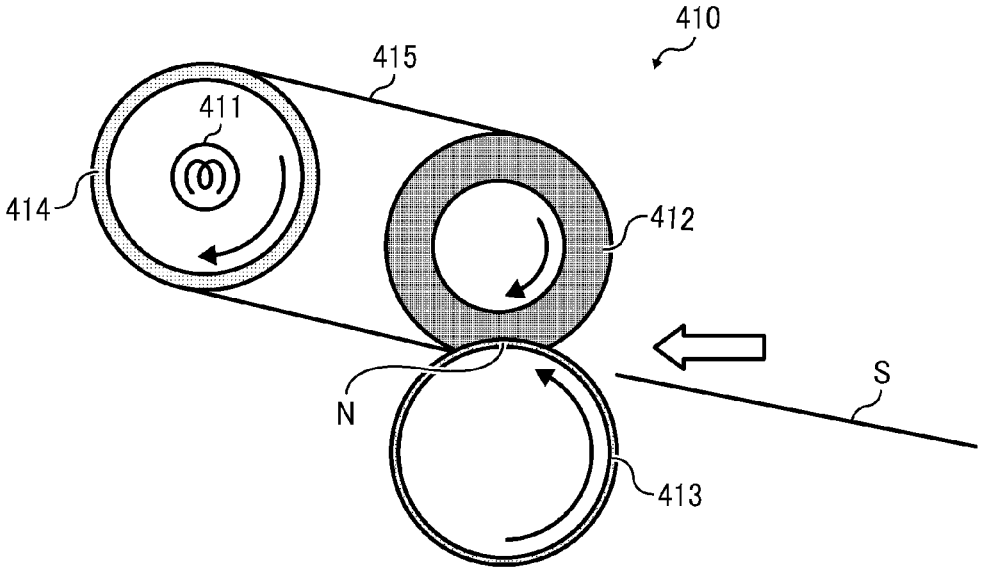
FIG. 2 BACKGROUND ART
FIG. 2 is an end-on, axial view of a belt-based fixing device employed in electrophotographic image formation.

Although in several embodiments described herein, the image forming apparatus 100 is depicted as incorporating a single fixing unit downstream from the imaging process to fix a toner image on a recording medium, in further embodiment, the image forming apparatus 100 may have an additional, pre-fixing device disposed between the imaging process and the fixing device to fix the toner image in place on the recording medium before processing through the fixing device. Examples of such pre-fixing device include those roller-based and belt based fixing devices depicted in FIGS. 1 and 2.

In such cases, the image forming apparatus 100 is selectively operable at least in a high-gloss mode in which the recording medium after image formation is passed through both the pre-fixing device and the fixing device to obtain a relatively high gloss on the toner image, or in a low-gloss mode in which the recording medium after image formation is passed through solely the pre-fixing device to obtain a relatively low gloss on the toner image.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device for processing a toner image on a recording medium, the device comprising:

a fuser member;

a stripper member parallel to the fuser member;

an endless rotary belt looped for rotation around the fuser member and the stripper member in a longitudinal, conveyance direction of the belt;

a heater adjacent to the belt to heat the belt;

a pressure member opposite the fuser member via the belt, the fuser member and the pressure member pressing against each other via the belt to form a fixing nip therebetween through which the recording medium is conveyed under heat and pressure, the recording medium after passage through the nip remaining in contact with the belt as the belt moves from the fuser member toward the stripper member, and separating from the belt as the belt passes around the stripper member; and a belt cooler including at least three cooling rollers inside the loop of the belt, each of which contacts the belt to rotate at a uniform speed with the belt, while maintained at a temperature lower than that of the belt to absorb heat from the belt to in turn cool the recording medium in contact with the belt, each of the cooling rollers being tangential to an inner circumferential surface of the belt to retain the belt in a curved configuration with a constant radius of curvature, at least one of the cooling rollers having a different diameter than that of the other cooling rollers.

2. The fixing device according to claim 1, wherein the belt cooler comprises an upstream cooling roller, an intermediate cooling roller, and a downstream cooling roller, arranged in series in the conveyance direction of the belt, with the intermediate cooling roller being the largest in outer diameter of all the cooling rollers.

3. The fixing device according to claim 1, wherein the belt cooler comprises an upstream cooling roller, an intermediate cooling roller, and a downstream cooling roller, arranged in series in the conveyance direction of the belt, with the downstream cooling roller being the largest in outer diameter of all the cooling rollers.

4. The fixing device according to claim 1, wherein he belt cooler comprises an upstream cooling roller, an intermediate cooling roller, and a downstream cooling roller, arranged in series in the conveyance direction of the belt, with the upstream cooling roller being the smallest in outer diameter of all the cooling rollers.

5. The fixing device according to claim 1, wherein the cooling roller includes:

a hollow, thermally conductive roller body to accommodate a liquid coolant;

a rotary joint connected to the roller body to define an inlet and an outlet through which the liquid coolant flows into and out of the roller body;

a heat dissipater connected to the rotary joint to dissipate heat from the liquid coolant for recirculation into the roller body.

6. The fixing device according to claim 5, wherein the heat dissipater includes a radiator that exhibits a cooling capability adjustable to maintain the cooling roller within a given temperature range.

7. The fixing device according to claim 5, wherein the heat dissipater includes a cooling fan to direct air flow at a flow rate adjustable to maintain the cooling roller within a given temperature range.

8. The fixing device according to claim 5, wherein the heat dissipater includes a pump to transfer the liquid coolant at a flow rate adjustable to maintain the cooling roller within a given temperature range.

9. The fixing device according to claim 1, wherein the cooling roller includes:

a hollow, thermally conductive open-ended roller body; and a cooling fan connected to the roller body to generate an air flow from one end to the other of the roller body.

10. The fixing device according to claim 1, wherein the cooling roller is maintained within a temperature ranging from approximately 30° C. to approximately 50° C.

11. An image forming apparatus comprising:

means for forming a toner image on a recording medium; and a fixing device to process the toner image with heat and pressure on the recording medium, the device comprising:

a fuser member;

a stripper member parallel to the fuser member;

an endless rotary belt looped for rotation around the fuser member and the stripper member in a longitudinal, conveyance direction of the belt;

a heater adjacent to the belt to heat the belt;

a pressure member opposite the fuser member via the belt, the fuser member and the pressure member pressing against each other via the belt to form a fixing nip therebetween through which the recording medium is conveyed under heat and pressure, the recording medium after passage through the nip remaining in contact with the belt as the belt moves from the fuser member toward the stripper member, and separating from the belt as the belt passes around the stripper member; and a belt cooler including at least three cooling rollers inside the loop of the belt, each of which contacts the belt to rotate at a uniform speed with the belt, while maintained at a temperature lower than that of the belt to absorb heat from the belt to in turn cool the recording medium in contact with the belt, each of the cooling rollers being tangential to an inner circumferential surface of the belt to retain the belt in a curved configuration with a constant radius of curvature, at least one of the cooling rollers having a different diameter than that of the other cooling rollers.

12. The image forming apparatus according to claim 11, further comprising a pre-fixing device disposed between the image forming means and the fixing device to fix the toner image in place on the recording medium before processing through the fixing device.

13. The image forming apparatus according to claim 12, wherein the image forming apparatus is selectively operable at least in a high-gloss mode in which the recording medium after image formation is passed through both the pre-fixing device and the fixing device to obtain a relatively high gloss on the toner image, or in a low-gloss mode in which the recording medium after image formation is passed through solely the pre-fixing device to obtain a relatively low gloss on the toner image.

* * * * *